US008681081B2

(12) United States Patent
Tsuda et al.

(10) Patent No.: US 8,681,081 B2
(45) Date of Patent: Mar. 25, 2014

(54) ACTIVE MATRIX TYPE DISPLAY DEVICE AND DRIVE CONTROL CIRCUIT USED IN THE SAME

(75) Inventors: Takuya Tsuda, Abiko (JP); Maki Sasagawa, Tokyo (JP); Ken Inada, Headington (GB)

(73) Assignee: Sharp Kabushiki Kaisha, Osaka (JP)

( * ) Notice: Subject to any disclaimer, the term of this patent is extended or adjusted under 35 U.S.C. 154(b) by 1067 days.

(21) Appl. No.: 11/632,829

(22) PCT Filed: Jul. 13, 2005

(86) PCT No.: PCT/JP2005/012934

§ 371 (c)(1),
(2), (4) Date: Aug. 22, 2008

(87) PCT Pub. No.: WO2006/009038

PCT Pub. Date: Jan. 26, 2006

(65) Prior Publication Data

US 2008/0309599 A1 Dec. 18, 2008

(30) Foreign Application Priority Data

Jul. 21, 2004 (JP) ..... 2004-212361

(51) Int. Cl.
*G09G 3/36* (2006.01)

(52) U.S. Cl.
USPC ..... 345/88; 345/90; 345/98; 345/103

(58) Field of Classification Search
USPC ..... 345/88, 90, 98–99, 103, 690
See application file for complete search history.

(56) References Cited

U.S. PATENT DOCUMENTS

| | | | | |
|---|---|---|---|---|
| 6,392,631 | B1 * | 5/2002 | Bertin et al. | 345/103 |
| 7,196,968 | B2 * | 3/2007 | Okuno et al. | 365/239 |
| 7,432,903 | B2 * | 10/2008 | Kato | 345/98 |
| 7,936,326 | B2 * | 5/2011 | Hashimoto et al. | 345/90 |
| 2002/0084966 | A1 * | 7/2002 | Yeo | 345/88 |
| 2002/0167016 | A1 * | 11/2002 | Hoelen et al. | 257/89 |
| 2003/0043132 | A1 * | 3/2003 | Nakamura | 345/204 |
| 2003/0063048 | A1 | 4/2003 | Nakano et al. | |
| 2004/0212633 | A1 | 10/2004 | Natori et al. | |

(Continued)

FOREIGN PATENT DOCUMENTS

| | | |
|---|---|---|
| EP | 1069457 | 1/2001 |
| JP | 3-74839 | 3/1991 |

(Continued)

OTHER PUBLICATIONS

International Search Report (PCT/ISA/210).

*Primary Examiner* — Matthew Fry
(74) *Attorney, Agent, or Firm* — Harness, Dickey & Pierce, P.L.C.

(57) ABSTRACT

In an active matrix display device including pixels of three colors having a stripe arrangement or a delta arrangement, n (n denotes a multiple of 3 that is 6 or larger) adjacent data lines form one group and are connected to a source signal output line. The ON/OFF of a selection switch provided for each data line is controlled so that, among the n data lines forming one group, data lines corresponding to pixels of a color with a contribution to brightness smaller than a contribution of at least another color among the three colors are connected first and last with the source signal output line during one horizontal period.

18 Claims, 12 Drawing Sheets

(56) References Cited

U.S. PATENT DOCUMENTS

| | | | | |
|---|---|---|---|---|
| 2005/0001537 | A1* | 1/2005 | West et al. | 313/500 |
| 2005/0140633 | A1* | 6/2005 | Kato | 345/96 |
| 2005/0195143 | A1* | 9/2005 | Toeda et al. | 345/88 |
| 2005/0219276 | A1* | 10/2005 | Nose et al. | 345/690 |
| 2007/0091050 | A1* | 4/2007 | Katayama et al. | 345/98 |
| 2007/0115231 | A1* | 5/2007 | Kumeta | 345/88 |

FOREIGN PATENT DOCUMENTS

| | | |
|---|---|---|
| JP | 2003-058119 | 2/2003 |
| JP | 2003-076334 | 3/2003 |
| JP | 2003-114656 | 4/2003 |
| JP | 2003-157051 | 5/2003 |
| JP | 2003-167556 | 6/2003 |
| JP | 2003-248461 | 9/2003 |
| JP | 2004-037498 | 2/2004 |

* cited by examiner

| | R1 | G1 | B1 | R2 | G2 | B2 |
|---|---|---|---|---|---|---|
| GL1 | 3 ← | 2 | 1 | 4 | 5 | 6 → |
| GL2 | 3 ← | 2 | 1 | 4 | 5 | 6 → |

FIG. 4

| | R1 | G1 | B1 | R2 | G2 | B2 |
|---|---|---|---|---|---|---|
| GL1 | 4 | 5 | 6 → | ← 3 | 2 | 1 |
| GL2 | 4 | 5 | 6 → | ← 3 | 2 | 1 |

FIG. 5

| | R1 | G1 | B1 | R2 | G2 | B2 |
|---|---|---|---|---|---|---|
| GL1 | 3 ← | 2 | 1 | 4 | 5 | 6 → |
| GL2 | 4 | 5 | 6 → | 3 ← | 2 | 1 |

FIG. 7

| | R1 | G1 | B1 | R2 | G2 | B2 |
|---|---|---|---|---|---|---|
| GL1 | 4 | 5 | 6 → | 3 ← | 2 | 1 |
| GL2 | 3 ← | 2 | 1 | 4 | 5 | 6 → |

FIG. 8

ACTIVE MATRIX TYPE DISPLAY DEVICE AND DRIVE CONTROL CIRCUIT USED IN THE SAME

TECHNICAL FIELD

The present invention relates to an active matrix display device such as a liquid crystal display device using thin film transistors (TFTs). More particularly, the present invention relates to an active matrix display device in which a plurality of data lines for transmitting video signals are connected as one unit to an output of a data line drive circuit, and also relates to a drive control circuit used therefor.

BACKGROUND ART

In recent years, liquid crystal display devices and electroluminescence (EL) display devices are used widely as flat panel displays. In particular, active matrix display devices having each pixel provided with a switching element have become widespread because of their intrinsic advantages such as high contrast and quick response.

As the switching elements, nonlinear resistance elements and semiconductor elements are used, and among them TFTs formed on a transparent insulation substrate are used because they enable the transmission display and also realize a large-sized screen easily. Especially, TFTs having a semiconductor layer at a channel portion made of polysilicon (p—Si) can realize a display device with smaller power consumption and enabling a more quick response as compared with a device made of amorphous silicon (a—Si).

The manufacturing cost of such an active matrix display device including TFTs may be higher than that of a display device without switching elements. However, a technology for suppressing the manufacturing cost while employing TFTs also has been proposed.

For instance, an active matrix display device having a plurality of data lines connected to be one line, which is then connected to an output signal line of a data line drive circuit via the equal number of TFTs is known (see Patent Document 1, for example).

An active matrix liquid crystal display device having the configuration described in this Patent Document will be described below with reference to FIG. 14 showing an equivalent circuit thereof. In FIG. 14, reference numeral 100 denotes a liquid crystal panel, 102 denotes a gate line drive circuit and 103 denotes a data line drive circuit. The gate line drive circuit 102 outputs a gate signal having a scanning select voltage or a scanning non-select voltage to each gate line (scanning line) GL. The data line drive circuit 103 outputs to each data line DL a data signal that is a video signal corresponding to the data line DL.

Although not illustrated, the liquid crystal panel 100 includes a matrix substrate and an opposing substrate that are in parallel and opposed to each other with a space of a predetermined distance therebetween, the space being filled with liquid crystals.

In this liquid crystal panel, a plurality of parallel data lines DL1 to DLN and a plurality of parallel gate lines GL1 to GLM crossing the data lines DLs are provided on the matrix substrate, and at each of the intersections of these data lines DLs and the gate lines GLs, a pixel electrode (not illustrated) and a pixel TFT 11 are provided. The pixel electrode forms a pixel that is one unit of the display with an opposing electrode 12 (described later) and a liquid crystal capacitance 10, and the pixel TFT 11 is provided for electrically connecting the pixel electrode to the corresponding data line DL. While a gate electrode of this pixel TFT 11 is connected with the above-stated gate line GL, a source electrode thereof is connected with a data line DL and a drain electrode thereof is connected with a pixel electrode.

In this configuration, when a gate line select voltage is applied to the gate electrode from the above-stated gate line drive circuit 102 (hereinafter called a writing period), the pixel TFT 11 is in a low resistance state (ON state), and therefore an electric potential of the data signal showing a video signal applied to the data line DL is transmitted from the above-stated data line drive circuit 103 to the pixel electrode, so as to make the electric potential of the pixel electrode equal to that of the data line DL. On the other hand, when a gate line non-select voltage is applied to the gate electrode (hereinafter called a retention period), the pixel TFT 11 is in a high resistance state (OFF state), and therefore the electrode potential of the pixel electrode is retained at the electric potential applied during the writing.

On the opposing substrate, the opposing electrode 12 serving as the other electrode of the liquid crystal capacitance 10 is formed. The opposing electrode 12 is provided on the entire surface of the opposing substrate to be common to all of the pixels. An appropriate common voltage is applied to the opposing electrode 12 from the matrix substrate side via a common terminal (not illustrated) provided on the periphery of the matrix substrate.

A voltage equivalent to an electric potential difference between the pixel electrode and the opposing electrode 12 is applied to the liquid crystal capacitance 10. By regulating this voltage, the transmissivity of liquid crystals can be controlled, thus enabling the display of an image.

The distinctive configuration proposed in the above-stated Patent Document 1 resides in that one data line DL is connected with a different data line DL via a second TFT 13 (hereinafter called a gate TFT 13) that is different from the pixel TFT 11 for driving liquid crystals as stated above, and these two DLs are grouped to be connected to an output signal line D of the data line drive circuit 103.

In this drawing, a data line DL2 connected with an output signal line D1 of the data line drive circuit 103 is connected with a data line DL1 via a gate TFT 13-1, and a data line DL4 connected with an output signal line D2 is connected with a data line DL3 via a gate TFT 13-2. Since N=12 in this drawing, six data line groups each including two data lines are formed in a similar manner. The gate electrodes of these six gate TFTs 13-1 to 13-6 are connected to a gate line GLa, and the open/close of these gate electrodes is controlled by a data line select signal supplied from a data line selection circuit 130 to the gate line GLa.

In the thus configured liquid crystal display device, in order to update an applied voltage charged to a liquid crystal capacitance 10-1 present at the intersection of the data line DL1 and the gate line GL1, the gate TFT 13-1 and the pixel TFT 11-1 should be turned ON. Thereby, a voltage of a data signal supplied from the data line drive circuit 103 to the data line DL1 is applied to the pixel electrode that is one of the electrodes of the liquid crystal capacitance 10-1, whereby the applied voltage of the liquid crystal capacitance 10-1 can be updated.

Incidentally, at this time, the applied voltage charged to a liquid crystal capacitance 10-2 present at the intersection of the data line DL2 and the gate line GL1 also is varied. However, immediately after the completion of the charge to the liquid crystal capacitance 11-1, the gate TFT 13-1 may be turned OFF, and at the same time a data signal output from the output signal line D1 may be updated, whereby the liquid crystal capacitance 10-2 can be recharged with a correct voltage.

FIG. 15 illustrates waveforms of drive signals applied to the liquid crystal panel 100 at this time (vertical synchronizing signal, horizontal synchronizing signal, data signal, data line selection signal that is a control signal of a gate TFT 13 and a gate signal applied to gate lines GL1 to GLM that is a control signal of a pixel TFT 11). Note here that the pixel TFTs 11 and the gate TFTs 13 used here are turned ON with a positive voltage as in the case of a n-channel FET, and M is 8.

With this configuration, the number of output buffers within the data line drive circuit 103 can be reduced to half of the number of the data lines DLs. This leads to a cost reduction that is more than the compensation for the cost-up due to the data line selection circuit 130 added for controlling the driving of the gate TFTs 13. The data line selection circuit 130 can be integrated within the gate line drive circuit 102 easily, and therefore it does not lead to a significant cost-up. Furthermore, since the number of the output signal lines D of the data line drive circuit 103 can be reduced to half as well, the assembly cost also can be reduced.

In the configuration of FIG. 14, however, since the driving order of the grouped data lines DLs is fixed to an arrangement order of the data lines DLs that is in accordance with the scanning direction, there is a problem of a display unevenness in a stripe pattern as described below, thus degrading an image quality.

TFTs have an intrinsic parasitic capacitance (stray capacitance), and in the case of the liquid crystal display of FIG. 14, there are a capacitance C1 between source and drain and a capacitance C2 between gate and drain of a gate TFT 13. Furthermore, although not illustrated, a pixel TFT 11 also has a similar stray capacitance. Moreover, a coupling capacitance C3 is present at an intersection of a data line DL and a gate line GL, and a capacitance C4 is present between a data line DL and an opposing electrode 12. In the case of TFTs made of amorphous silicon, the ON resistance reaches a several mega Ω, and therefore even a parasitic capacitance cannot be ignored.

In particular, when the electric potential of the gate line GLa falls, there is a considerable influence of the leak of electric charge in the liquid crystal capacitance 10-1 through the capacitance C2. Furthermore, during the charging of the liquid crystal capacitance 11-2, since the pixel TFT 11-1 in the adjacent pixel also is in ON state, the electric charge may be transferred between the capacitance C4 and the liquid crystal capacitance 10-1 due to an even small factor.

In a liquid crystal display device, the transmissivity is determined by an effective value of a voltage applied to liquid crystals. Therefore, even when trying to display a solid image, a display unevenness in a vertical striped shape corresponding to one dot occurs in the image because there is a difference in voltages applied to the liquid crystal capacitances 10 between the pixels driven by an odd-numbered data line DL1, DL3, . . . (group a) and the pixels driven by an even-numbered data line DL2, DL4, . . . (group b) of two data lines DLs forming a group, and therefore a practically sufficient image quality cannot be obtained.

Such an electric potential variation in the liquid crystal capacitance 10 results from a parasitic capacitance present between a pixel electrode of each pixel and a data line DL located on the right side. If such a parasitic capacitance is present, an electric potential variation in the data line located on the right side will be conveyed to a pixel electrode in an adjacent pixel on the left side that is the other electrode of the parasitic capacitance because of the capacitive coupling, so that the charged voltage of the liquid crystal capacitance 10 of the corresponding pixel will be varied.

More specifically, a variation range of the electric potential of the liquid crystal capacitance 10 due to the electric potential variation in the adjacent data line DL will be as follows: in the case where the electric potential is varied in the data line DL by 4 V, $\Delta V=4\times Csd/(Cpix+Csd)=0.078$ V, where the electric charge amount Cpix of the liquid crystal capacitance 10 is 100 fF, and the electric charge amount Csd of the parasitic capacitance is 2 fF.

Since the voltage amplitude of liquid crystals (the maximum voltage applied to the liquid crystal capacitance 10) is around 5 V in general and one gray level will be 0.0195 V when 256 levels of gray should be displayed. Therefore, the variation as much as 0.078 V corresponds to four gray levels, which appears as a variation that is sufficiently recognizable with human eyes. Furthermore, in the case of a smaller voltage amplitude than the above, a visual variation will increase more, and therefore the influence thereof cannot be ignored.

Note here that although FIG. 14 exemplifies the configuration having two data lines DLs connected as one group to an output signal line D of the data line drive circuit 103, the number of the data lines in one group is not limited to two. As long as the pixels corresponding to a plurality of data lines DLs are driven successively in accordance with the scanning direction, a difference in the charged voltage of the liquid crystal capacitances 10 will increase between the first driven pixel and the last driven pixel in one horizontal period, thus causing a display unevenness in a stripe pattern.

In view of such a problem, another configuration has been proposed also, in which the connecting order of a plurality of data lines forming a group with an output signal line of a data line drive circuit is changed from one gate line to another and, even for the same gate line, the order is made different for each scanning operation (see Patent Document 2).

Patent Document 1: JP 1103 (1991)-74839 A

Patent Document 2: JP 2003-58119 A (FIG. 2 and FIG. 5)

DISCLOSURE OF INVENTION

Problems to be Solved by the Invention

However, the technology disclosed in the above Patent Document 2 does not consider a display unevenness in an active matrix display device provided with a color filter.

In recent years, the number of pixels tends to increase in order to realize a higher-definition image, and therefore an active matrix display device having six or more data lines grouped to be connected to one output signal line of a data line drive circuit is now being realized.

The inventors of the present invention found, particularly concerning an active matrix display device having six or more data lines grouped to be connected to one output signal line of a data line drive circuit and including a color filter, a technology for reducing the degradation of an image quality due to a parasitic capacitance or the like effectively. In other words, it is an object of the present invention to provide an active matrix display device having a high display quality by reducing the degradation of an image quality due to a parasitic capacitance or the like and also to provide a drive control circuit used therefor.

Means for Solving Problem

In order to achieve the above-stated object, an active matrix display device of the present invention includes: pixels of three colors that form a stripe arrangement or a delta arrangement; a plurality of scanning lines and a plurality of data lines that are provided corresponding to the arrangement of the pixels; and switching elements each corresponding to each of the pixels, provided in the vicinity of intersections of the scanning lines and the data lines, wherein ON/OFF of the switching elements is controlled by signals flowing through the scanning lines, and when a switching element is turned ON, a signal flowing through a data line is written in a pixel corresponding to the switching element. Among the plurality of data lines, n (n denotes a multiple of 3 that is 6 or larger) adjacent data lines form one group and are connected to each of output signal lines of a data line drive circuit that generates a signal to be output to each data line, and each data line is provided with a selection switch that controls electrical continuity between the data line and the corresponding output signal line of the data line drive circuit. The active matrix display device further includes a selection order changing section that controls ON/OFF of the selection switches so as to control an order of connecting the n data lines forming one group with the corresponding output signal line of the data line drive circuit, and the selection order changing section controls the order so that, among the n data lines forming one group, data lines corresponding to pixels of a color with a contribution to brightness smaller than a contribution of at least another color among the three colors are connected first and last with the corresponding output signal line of the data line drive circuit during one horizontal period.

During one horizontal period, an electric potential of a pixel to which writing is performed earlier is likely to vary at the time of the subsequent wiring to an adjacent pixel due to a parasitic capacitance within each pixel or the like. Therefore, an electric potential difference between the first written pixel and the last written pixel increases in one horizontal period, thus causing a difference in brightness between these pixels. According to the above-stated configuration, however, data lines corresponding to pixels of a color with a contribution to brightness smaller than a contribution of at least another color among the three colors are connected first and last with the corresponding output signal line of the data line drive circuit during one horizontal period, and therefore a difference in the brightness between the first written pixel and the last written pixel can be made small. As a result, a display unevenness can be obscure for human's eyes, and therefore an active matrix display device having a high display quality can be provided.

In the above-stated active matrix display device, it is preferable that the three colors are three primary colors of red, green and blue, and the selection order changing section controls the order so that, among the n data lines forming one group, data lines corresponding to blue pixels are connected first and last with the corresponding output signal line of the data line drive circuit during one horizontal period. Since blue is a color with the smallest contribution to the brightness among three primary colors, a difference in the brightness between the first written pixel and the last written pixel can be minimized in one horizontal period.

In the above-stated active matrix display device, it is preferable that the three colors are three primary colors of red, green and blue, and the selection order changing section controls the order so that, among the n data lines forming one group, data lines corresponding to red pixels are connected first and last with the corresponding output signal line of the data line drive circuit during one horizontal period. Since red is a color with the second smallest contribution to the brightness among three primary colors, a difference in the brightness between the first written pixel and the last written pixel can be made small.

In the above-stated active matrix display device, it is preferable that the selection order changing section controls the order of connecting the n data lines forming one group with the corresponding output signal line of the data line drive circuit so that the order is different from one horizontal period to another. Bright and dark pixels are located differently from one horizontal period to another, which means that bright pixels and dark pixels are dispersed spatially, and therefore a display unevenness can be made more obscure.

In the above-stated active matrix display device, it is preferable that the selection order changing section controls the order of connecting the n data lines forming one group with the corresponding output signal line of the data line drive circuit so that the order is different from one vertical period to another. Bright and dark pixels are located differently from one frame to another and therefore a display unevenness can be made more obscure.

In the above-stated active matrix display device, it is preferable that the selection order changing section controls the order of connecting the n data lines forming one group with the corresponding output signal line of the data line drive circuit so that the order is different from one horizontal period to another and from one vertical period to another. Bright and dark pixels are located differently from one horizontal period to another and from one frame to another and therefore a display unevenness can be made further more obscure. Especially in the case of a stripe arrangement of pixels, since bright pixels and dark pixels are uniformly dispersed spatially (in a staggered arrangement), and therefore the effect of obscuring a display unevenness is large.

The technical idea of the present invention can be embodied also as a drive control circuit used for an active matrix display device. The drive control circuit of the present invention may be externally connected to a display such as a liquid crystal panel in the active matrix display device, or may be mounted monolithically to a display such as a liquid crystal panel.

A drive control circuit according to the present invention is used for an active matrix display device including: pixels of three colors that form a stripe arrangement or a delta arrangement; a plurality of scanning lines and a plurality of data lines that are provided corresponding to the arrangement of the pixels; and switching elements each corresponding to each of the pixels, provided in the vicinity of intersections of the scanning lines and the data lines, wherein ON/OFF of the switching elements is controlled by signals flowing through the scanning lines, and when a switching element is turned ON, a signal flowing through a data line is written in a pixel corresponding to the switching element, wherein among the plurality of data lines, n (n denotes a multiple of 3 that is 6 or larger) adjacent data lines form one group and are connected to each of output signal lines of a data line drive circuit that generates a signal to be output to each data line, and each data line is provided with a selection switch that controls electrical continuity between the data line and the corresponding output signal line of the data line drive circuit. The drive control circuit includes a selection order changing section that controls ON/OFF of the selection switches so as to control an order of connecting the n data lines forming one group with the corresponding output signal line of the data line drive circuit, and the selection order changing section controls the order so that, among the n data lines forming one group, data lines corresponding to pixels of a color with a contribution to brightness smaller than a contribution of at least another color among the three colors are connected first and last with the corresponding output signal line of the data line drive circuit during one horizontal period.

According to the above-stated configuration, data lines corresponding to pixels of a color with a contribution to brightness smaller than a contribution of at least another color among the three colors are connected first and last with the corresponding output signal line of the data line drive circuit during one horizontal period, and therefore a difference in the brightness between the first written pixel and the last written pixel can be made small. As a result, a display unevenness can be obscure for human's eyes, and therefore a driving control circuit embodying an active matrix display device having a high display quality can be provided.

In the drive control circuit according to the present invention, it is preferable that the three colors are three primary colors of red, green and blue, and the selection order changing section controls the order so that, among the n data lines forming one group, data lines corresponding to blue pixels are connected first and last with the corresponding output signal line of the data line drive circuit during one horizontal period. Since blue is a color with the smallest contribution to the brightness among three primary colors, a difference in the brightness between the first written pixel and the last written pixel can be minimized in one horizontal period.

In the drive control circuit according to the present invention, it is preferable that the three colors are three primary colors of red, green and blue, and the selection order changing section controls the order so that, among the n data lines forming one group, data lines corresponding to red pixels are connected first and last with the corresponding output signal line of the data line drive circuit during one horizontal period. Since red is a color with the second smallest contribution to the brightness among three primary colors, a difference in the brightness between the first written pixel and the last written pixel can be made small.

In the drive control circuit according to the present invention, it is preferable that the selection order changing section controls the order of connecting the n data lines forming one group with the corresponding output signal line of the data line drive circuit so that the order is different from one horizontal period to another. Bright and dark pixels are located differently from one horizontal period to another, which means that bright pixels and dark pixels are dispersed spatially, and therefore a display unevenness can be made more obscure.

In the drive control circuit according to the present invention, it is preferable that the selection order changing section controls the order of connecting the n data lines forming one group with the corresponding output signal line of the data line drive circuit so that the order is different from one vertical period to another. Bright and dark pixels are located differently from one frame to another and therefore a display unevenness can be made more obscure.

In the drive control circuit according to the present invention, it is preferable that the selection order changing section controls the order of connecting the n data lines forming one group with the corresponding output signal line of the data line drive circuit so that the order is different from one horizontal period to another and from one vertical period to another. Bright and dark pixels are located differently from one horizontal period to another and from one frame to another and therefore a display unevenness can be made further more obscure. Especially in the case of a stripe arrangement of pixels, since bright pixels and dark pixels are uniformly dispersed spatially (in a staggered arrangement), and therefore the effect of obscuring a display unevenness is large.

Effects of the Invention

As stated above, according to the present invention, data lines corresponding to pixels of a color with a contribution to brightness smaller than a contribution of at least another color among the three colors are connected first and last with the corresponding output signal line of the data line drive circuit during one horizontal period, and therefore a difference in the brightness between the first written pixel and the last written pixel can be made small. As a result, an active matrix display device having a high display quality can be provided.

BRIEF DESCRIPTION OF DRAWINGS

FIG. 4 is for explaining one exemplary driving order of pixels in the active matrix liquid crystal display device in accordance with Embodiment 1 of the present invention.

FIG. 5 is for explaining another exemplary driving order of pixels in the active matrix liquid crystal display device in accordance with Embodiment 1 of the present invention.

FIG. 7 is for explaining still another exemplary driving order of pixels in the active matrix liquid crystal display device in accordance with Embodiment 1 of the present invention.

FIG. 8 is for explaining a further exemplary driving order of pixels in the active matrix liquid crystal display device in accordance with Embodiment 1 of the present invention.

EXPLANATIONS OF REFERENCE NUMERALS

Figure 1:
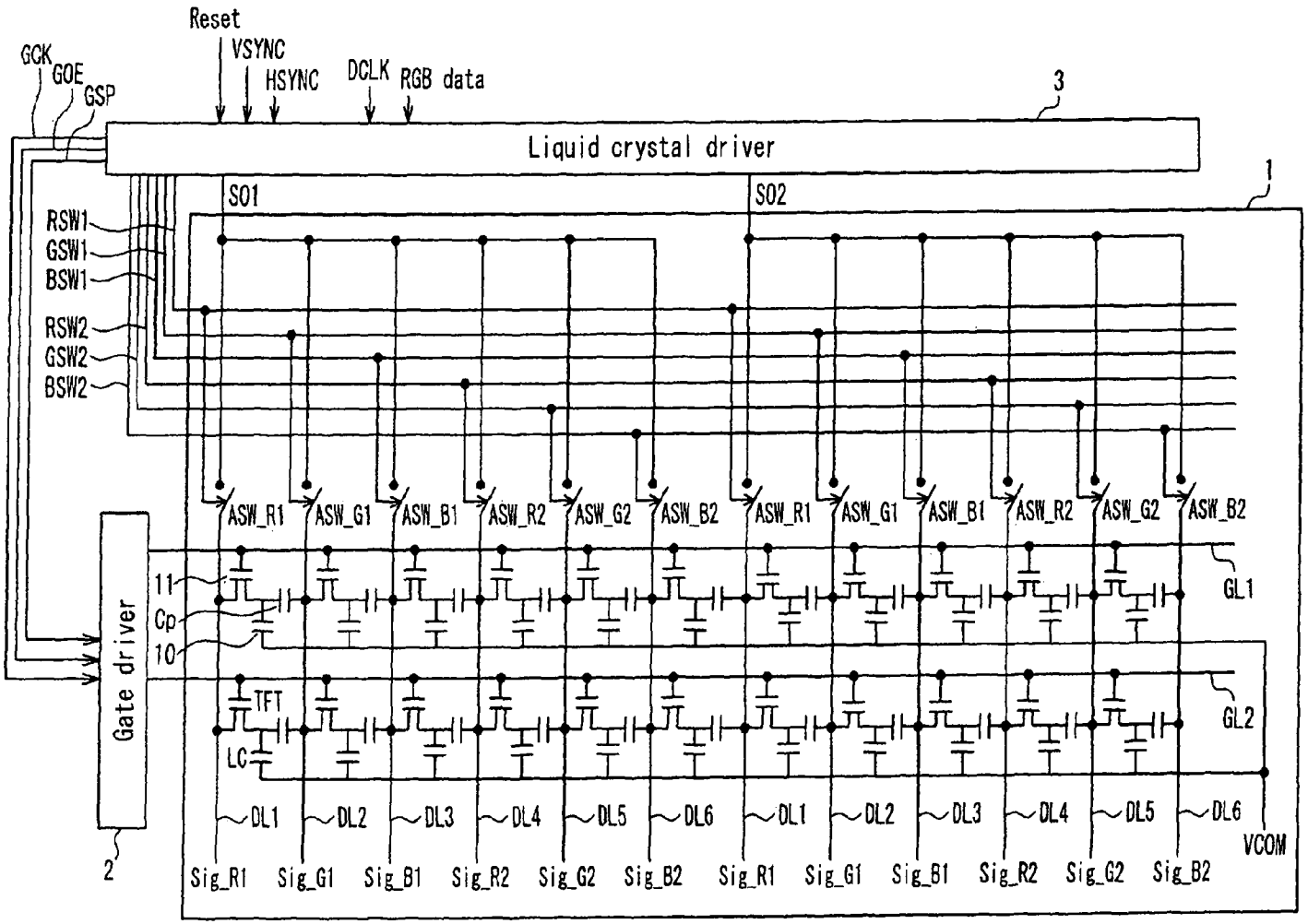
FIG. 1 is an equivalent circuit diagram illustrating the configuration of an active matrix liquid crystal display device in accordance with Embodiment 1 of the present invention.

1, 21: liquid crystal panel
2: gate driver
3: liquid crystal driver (drive control circuit)
4: data line selection circuit
10: liquid crystal capacitance
11: pixel TFT
12: opposing electrode
13: gate TFT
31: gate controller
32: timing controller
33: RGB time-division controller (selection order changing section)
34: shift register
35: data register
36: data latch circuit
37: RGB time-division switch
38: level shifter
39: D/A converter
40: output buffer
41: gray-level reference voltage generation circuit
SO: source signal output line
DL: data line
GL: gate line
ASW: selection switch

DESCRIPTION OF THE INVENTION

The following describes embodiments of the present invention. In the following description, liquid crystal display devices are simply exemplified as active matrix display devices. However, the present invention is not limited to these and is applicable to any active matrix display device such as an EL display device.

[Embodiment 1]

Referring now to FIG. 1 to FIG. 11, one embodiment of the present invention will be described below.

FIG. 1 is an equivalent circuit diagram illustrating the major configuration of an active matrix liquid crystal display device in accordance with the present embodiment. As shown in FIG. 1, the liquid crystal display device of the present embodiment mainly includes a liquid crystal panel 1, a gate driver 2 and a liquid crystal driver 3 (drive control circuit).

Although not illustrated, the liquid crystal panel 1 includes a matrix substrate and an opposing substrate that are in parallel and opposed to each other with a space of a predetermined distance therebetween, the space being filled with liquid crystals.

The matrix substrate is provided with parallel N data lines DL1 to DLN and a plurality of parallel gate lines GL1 to GLM crossing the data lines DLs, and at each of the intersections of these data lines DLs and the gate lines GLs, a pixel electrode (not illustrated) and a pixel TFT 11 are provided. A liquid crystal capacitance 10 between the pixel electrode and an opposing electrode forms a pixel that is one unit of the display, and the pixel TFT 11 is provided for electrically connecting the pixel electrode to the data line DL. While a gate electrode of the pixel TFT 11 is connected with the corresponding gate line GL, a source electrode thereof is connected with a data line DL and a drain electrode thereof is connected with a pixel electrode.

When a gate line select voltage is applied to the gate electrode of the pixel TFT 11 from a gate driver 2 via the gate line GL (writing period), the pixel TFT 11 is in a low resistance state (ON state). When the pixel TFT 11 is in an ON state, an electric potential of a data signal showing a video signal applied to the data line DL is transmitted from the liquid crystal driver 3 to the pixel electrode connected with the pixel TFT 11, so as to make the electric potential of the pixel electrode equal to that of the data line DL. On the other hand, when a gate line non-select voltage is applied to the gate electrode (retention period), the pixel TFT 11 is in a high resistance state (OFF state), and therefore the electrode potential of the pixel electrode connected with the pixel TFT 11 is retained at the electric potential applied during the writing.

On the opposing substrate, the above-stated opposing electrode is formed, which is paired with the pixel electrode for the liquid crystal capacitance 10. The opposing electrode is provided on the entire surface of the opposing substrate to be common to all of the pixels. An appropriate common voltage is applied to the opposing electrode from the matrix substrate side via a common terminal (not illustrated) provided on the periphery of the matrix substrate.

A voltage equivalent to an electric potential difference between the pixel electrode and the opposing electrode is applied to the liquid crystal capacitance 10. By regulating this voltage, the transmissivity of liquid crystals can be controlled, thus enabling the display of an image.

Figure 2:
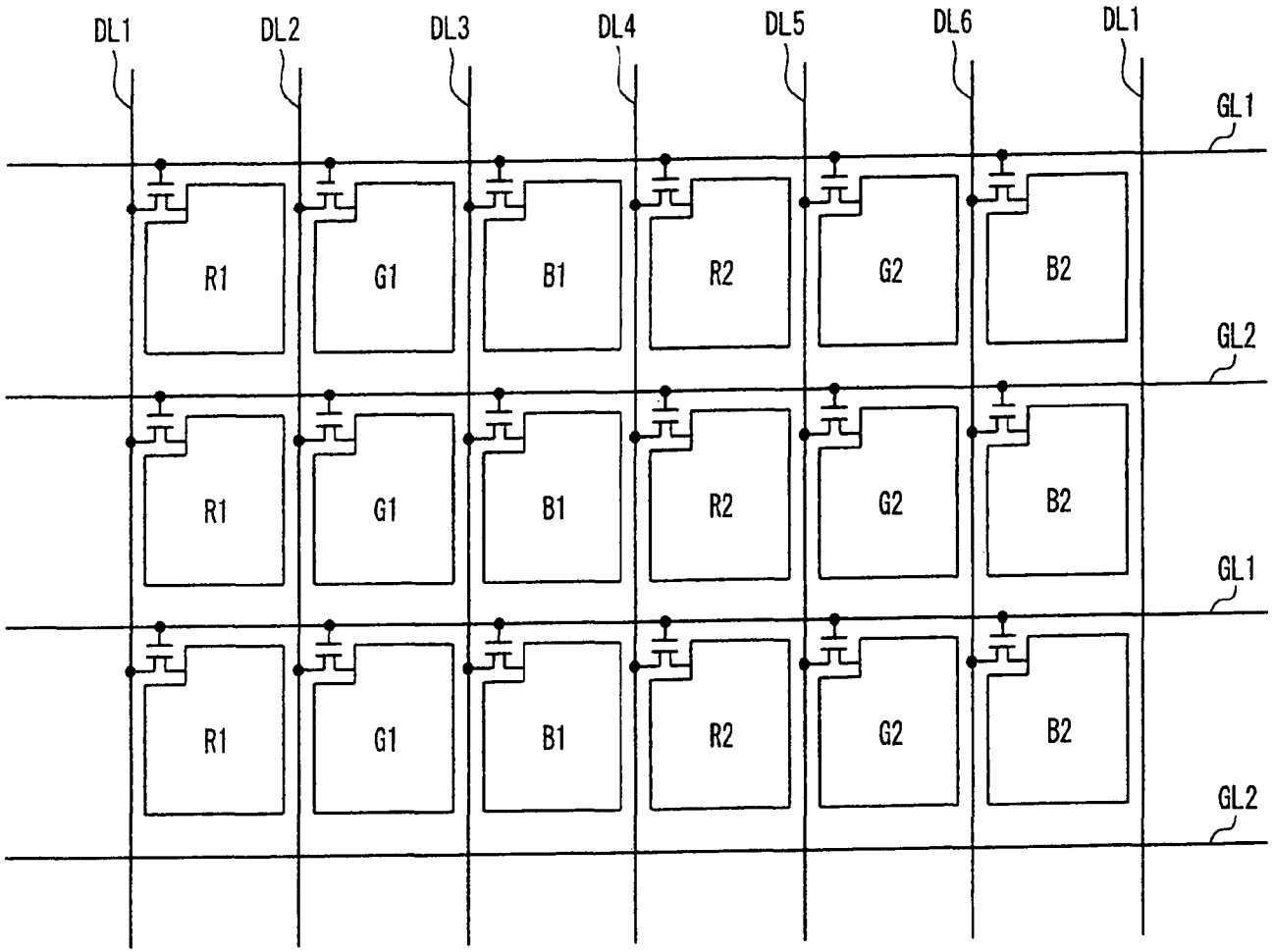
FIG. 2 is for explaining a color pixel arrangement of the active matrix liquid crystal display device in accordance with Embodiment 1 of the present invention.

The liquid crystal panel 1, as shown in FIG. 2, has a so-called stripe-arranged color filter layer in which red (R) filters, green (G) filters and blue (B) filters are arranged in a stripe shape. FIG. 2 illustrates the state where the respective RGB filters of the color filter layer are arranged so as to align with pixel electrodes on the matrix substrate in the direction perpendicular to the substrate. Actually, the color filter layer is provided not on the matrix substrate side but on the opposing substrate side. As described later in detail, six data lines DLs of the liquid crystal panel 1 are grouped to be connected to a source signal output line SO of the liquid crystal driver 3. In the liquid crystal panel 1, color filters corresponding to the pixel electrodes connected with the six data lines DL1 to DL6 in one group will be called hereinafter R1, G1, B1, R2, G2 and B2 so as to correspond to their colors as shown in FIG. 2. The six pixels corresponding to the six data lines DL1 to DL6 in one group also may be referred to as the pixels R1, G1, B1, R2, G2 and B2, respectively.

Each of the six data lines DL1 to DL6 in one group is provided with a switch ASW for controlling the electrical continuity with the source signal output line SO. Hereinafter, the switch corresponding to the pixel R1 is called ASW_R, the switch corresponding to the pixel G1 is called ASW_G1, the switch corresponding to the pixel B1 is called ASW_B1, the switch corresponding to the pixel R2 is called ASW_R2, the switch corresponding to the pixel G2 is called ASW_G2 and the switch corresponding to the pixel B2 is called ASW_B2.

The liquid crystal driver 3 controls the open/close of the switches ASWs, whereby the connection of the six data lines DL1 to DL6 with the source signal output line SO can be established in a predetermined order. The switch ASWs can be formed of TFTs as in the case of the pixel TFTs 11.

For the sake of clarity, FIG. 1 illustrates only two source output signal lines SO1 and SO2 and the corresponding twelve data lines DLs in total in two groups. Needless to say, the numbers of the source output signal lines and the data lines are far more than these in general. The same goes for the number of the gate lines GLs. In addition, FIG. 1 illustrates pixels within the display area only, and omits the illustration of dummy pixels on the periphery of the display area.

During one horizontal period, the gate driver 2 applies a scanning select voltage to only one of the M gate lines (scanning lines) GL1 to GLM, while applying a non-scanning select voltage to the remaining gate lines.

The liquid crystal driver 3 is a circuit with a controller and a source driver integrated therein. The liquid crystal driver 3 outputs a reset signal (Reset), a vertical synchronizing signal (VSYNC), a horizontal synchronizing signal (HSYNC), a clock signal (DCLK) and a video signal (data signal) corresponding to each of the RGB pixels that is in response to a RGB data signal as an input. The liquid crystal driver 3 further supplies a gate clock signal (GCK), a gate output enable signal (GOE) and a gate start pulse signal (GSP) to the gate driver 2 in order to control the operation of the gate driver 2. In order to control the open/close of the switches ASWs connected with the six data lines DL1 to DL6 in one group respectively, the liquid crystal driver 3 further outputs pixel selection signals RSW1, GSW1, BSW1, RSW2, GSW2 and BSW2. The internal configuration of the liquid crystal driver 3 will be described later in detail.

As described above concerning the conventional technology described in Patent Document 1, in the case where the driving order of the thus grouped six data lines DL1 to DL6 is a constant order in accordance with the scanning direction, i.e., they are driven in the order of the pixels R1, G1, B1, R2, G2 and B2, a vertical stripe pattern different from one line (corresponding to three RGB pixels) to another will appear at the boundary position between the pixel B2 and the pixel R1, which degrades a display quality considerably.

Then, according to the liquid crystal display device of the present embodiment, the liquid crystal driver 3 controls the output operation of the pixel selection signals RSW1, GSW1, BSW1, RSW2, GSW2 and BSW2 so that the six pixels R1, G1, B1, R2, G2 and B2 (corresponding to the data lines DL1 to DL6 in one group) of FIG. 2 are driven in the order starting from a blue pixel (B1) and ending with another blue pixel (B2).

Figure 3:
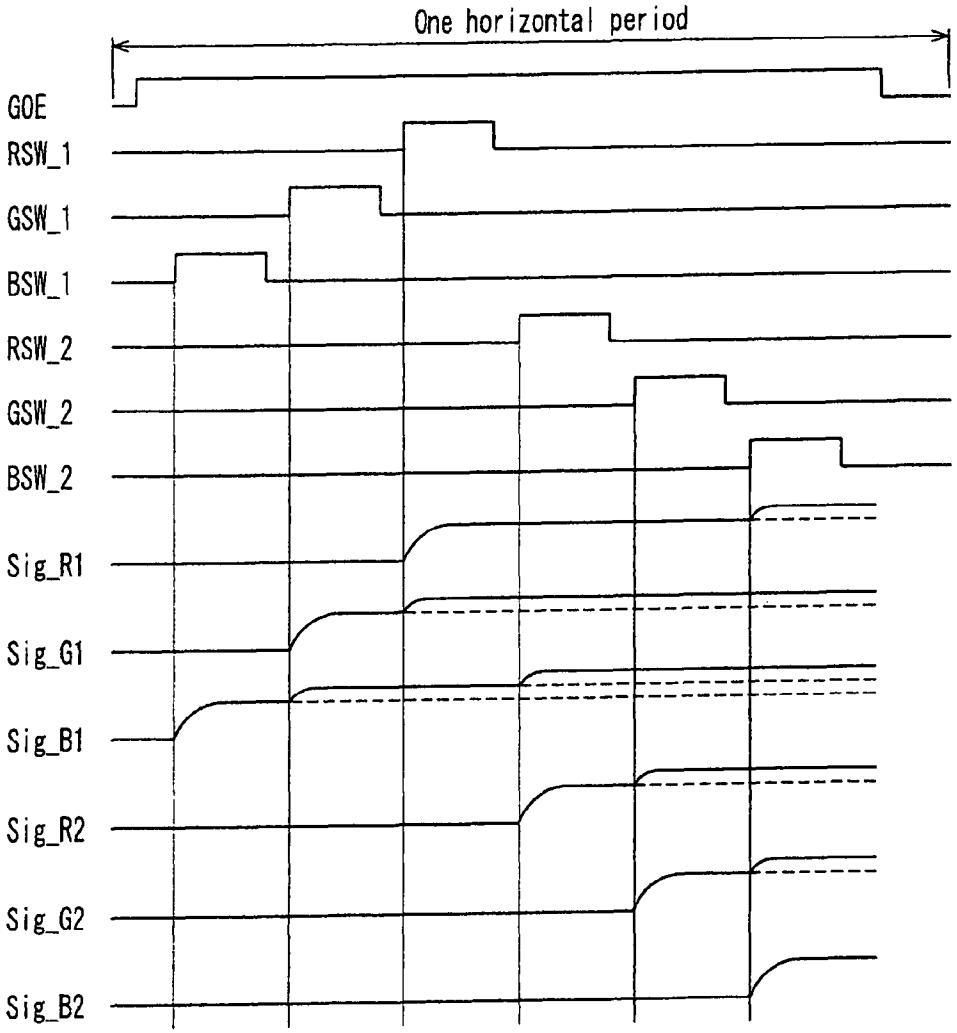
FIG. 3 shows waveforms of major driving signals in the active matrix liquid crystal display device in accordance with Embodiment 1 of the present invention.

Among the driving signals supplied from the liquid crystal driver 3 in the liquid crystal display device of the present embodiment, FIG. 3 illustrates waveforms of the gate output enable signal (GOE), the pixel selection signals (RSW1, GSW1, BSW1, RSW2, GSW2 and BSW2) and data signals given from the source signal output line SO to the pixels R1, G1, B1, R2, G2 and B2 (Sig_R1, Sig_G1, Sig_B1, Sig_R2, Sig_G2 and Sig_B2). As shown in FIG. 3, the liquid crystal driver 3 sets the pixel selection signals during one horizontal period so that they are turned HIGH (ON state) successively in the order of BSW1, GSW1, RSW1, RSW2, GSW2 and BSW2. At a certain point of the period, only one of the pixel selection signals is in ON state. For instance, while BSW1 is in ON state, the other pixel selection signals are kept LOW (OFF state). Then, when BSW1 is turned OFF, only GSW1 is turned ON, and the other pixel selection signals are kept OFF.

As stated above, when the pixel selection signal BSW1 is set in ON state, the switch ASW_B1 is closed, so that the source signal output line SO can be electrically continuous with the data line DL3. At this time, the liquid crystal driver 3 supplies to the data line DL3 a data signal Sig_B1 corresponding to the pixel B1. Next, when the pixel selection signal GSW1 is set in ON state, the switch ASW_G1 is closed, so that the source signal output line SO can be electrically continuous with the data line DL2. At this time, the liquid crystal driver 3 supplies to the data line DL2 a data signal Sig_G1 corresponding to the pixel G1.

In this way, the pixel selection signals are set in ON state successively in the order of BSW1, GSW1, RSW1, RSW2, GSW2 and BSW2, whereby the six pixels (R1, G1, B1, R2, G2 and B2) corresponding to the six data lines DLs in one group are driven in the order of B1, G1, R1, R2, G2 and B2, as shown in FIG. 4. Herein, in FIG. 4 to FIG. 5 and FIG. 7 to FIG. 10, the numbers indicated within the frames represent the driving order of the corresponding pixels.

The following describes the effects obtained by driving the six pixels corresponding to the six data lines DLs in one group in the order of B1, G1, R1, R2, G2 and B2.

As shown in FIG. 3, when the data signal Sig_B1 is supplied to the pixel B1 firstly, the liquid crystal capacitance 10 of the pixel B1 is charged to a predetermined voltage. Next, when the data signal Sig_G1 is supplied to the pixel G1, the liquid crystal capacitance 10 of the pixel G1 is charged to a predetermined voltage. At this time, however, the electric potential of the pixel B1 that is adjacent on the right side of the pixel G1, to which the writing has been performed already, is varied due to the influence of the writing to the pixel G1. Such a variation in the electric potential of the liquid crystal capacitance 10 results from a parasitic capacitance Cp (see FIG. 1) present between a pixel electrode of each pixel and a data line DL located on the right side.

Subsequently, when the data signal Sig_R1 is supplied to the pixel R1 so as to charge the liquid crystal capacitance 10 of the pixel R1 to a predetermined voltage, the electric potential of the pixel G1 that is adjacent on the right side of the pixel R1, to which the writing has been performed already, is varied due to the influence of the writing to the pixel R1.

Next, when the data signal Sig_R2 is supplied to the pixel R2, the liquid crystal capacitance 10 of the pixel R2 is charged to a predetermined voltage. At this time, the electric potential of the pixel B1 that is adjacent on the left side of the pixel R2 is varied because of the influence of the electric potential of the data line DL4 that is varied during the writing to the pixel R2. Incidentally, at the time of the writing to the pixel R2, the electric potential of the liquid crystal capacitance of the pixel G2 that is adjacent on the right side of the pixel R2 also is varied due to the influence. However, immediately afterward the writing is performed to the pixel G2 so as to charge the pixel to a desired electric potential, and therefore the influence will not remain.

Furthermore, at the time of the writing to the pixel G2, since the electric potential of the data line DL5 is varied, the electric potential of the pixel R2 that is adjacent on the left side of the pixel G2 is varied because of the influence of the writing to the pixel G2. Similarly to the above, the electric potential of the liquid crystal capacitance of the pixel B2 that is adjacent on the right side of the pixel G2 is varied due to the influence of the writing to the pixel G2. However, immediately afterward the writing is performed to the pixel B2 so as to charge the pixel to a desired electric potential, and therefore the influence will not remain.

Moreover, at the writing to the pixel B2, the electric potential of the pixel R1 adjacent on the right side of the pixel B2 is varied due to the influence of the writing.

As is understood from the above explanations and FIG. 3, among the six pixels, the electric potential of the pixel B1 that is driven first is the highest, and the electric potential of the pixel B2 that is driven last is the lowest. Such a difference in the electric potential between the first driven pixel and the last driven pixel will be a factor of generating a display unevenness in a stripe pattern. For instance, in the case of a normally-white liquid crystal panel, a higher electric potential of the liquid crystal capacitance 10 makes a pixel displayed darker. Therefore, in the case of FIG. 3, the pixel B2 will be brighter than the pixel B1. On the contrary, in the case of a normally-black panel, the pixel B1 will be brighter than the pixel B2. However, blue is a color with the smallest contribution to the brightness among three primary colors of red, green and blue. Therefore, the driving order of the six pixels is controlled so that a pair of pixels having the largest electric potential difference in one horizontal period are blue pixels as in the present embodiment, whereby the influence on the human's visual impression can be minimized.

Note here that the "contribution to the brightness" can be represented as "luminous quantity (the amount of light sensed by human's eyes)" or "luminous factor". Even if a constant energy of light is received, human's eyes sense the brightness of the light differently depending on the wavelength of the light. Such characteristics are called luminous factor characteristics. Although the luminous factor characteristics may be changed with the surrounding brightness, it can be said that the green light has the highest luminous factor among three primary colors in a normal operational environment for a display device and the blue light has the lowest luminous factor.

Figure 6:
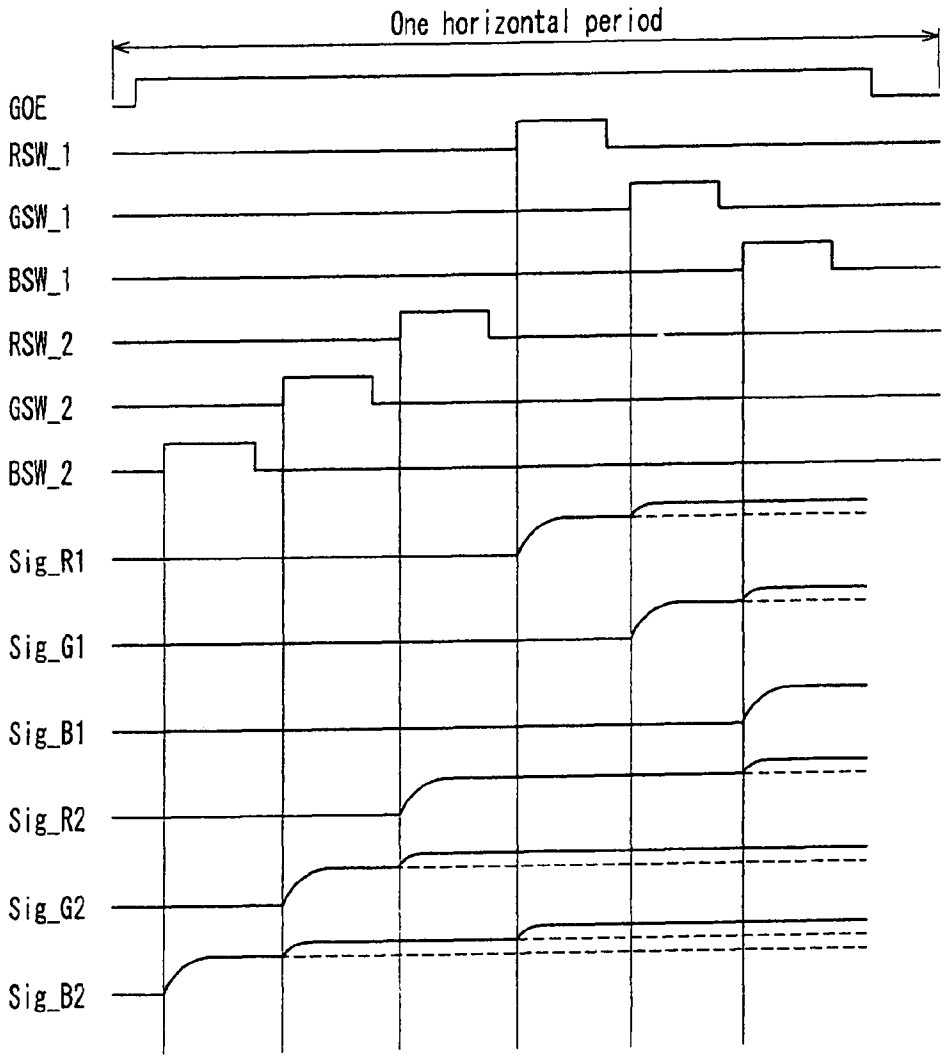
FIG. 6 shows waveforms of major driving signals for implementing the driving order of FIG. 5 in the active matrix liquid crystal display device in accordance with Embodiment 1 of the present invention.

In the above description, the first driven pixel is B1 and the last driven pixel is B2. Alternatively, as shown in FIG. 5, the first driven pixel may be B2 and the last driven pixel may be B1. In this case, the driving signals supplied from the liquid crystal driver 3 are as shown in FIG. 6. Note here that as long as the first and the last driven pixels are blue, the second to fifth driving order of the pixels can be any order, from which similar effects can be obtained.

Furthermore, among three primary colors, green has the highest contribution to brightness, and red follows green. A difference in the contribution between red and blue is not so much as a difference between green and red. Therefore, even when the first driven pixel is red (R1 or R2) and the last drive pixel is red (R2 or R1), effects obtained will be similar to those obtained from the case where the first and last driven pixels are blue in terms of the prevention of a display unevenness in a stripe pattern.

In addition, in the driving methods shown in FIG. 4 and FIG. 5, the driving order of the pixels are the same between the odd-numbered gate lines and the even-numbered gate lines. However, as shown in FIG. 7 or FIG. 8, the driving order of the pixels may be different between the odd-numbered gate lines and the even-numbered gate lines.

Furthermore, the driving order of pixels may be different from one frame to another. Thereby, the contrast of the pixels will be varied for each frame, which leads to an advantage of further obscuring a display unevenness. For example, as shown in FIG. 9, the pixels may be driven in the order of B1, G1, R1, R2, G2 and B2 during an even-numbered frame, whereas they may be driven in the order of B2, G2, R2, R1, G1 and B1 during an odd-numbered frame.

Figure 10:
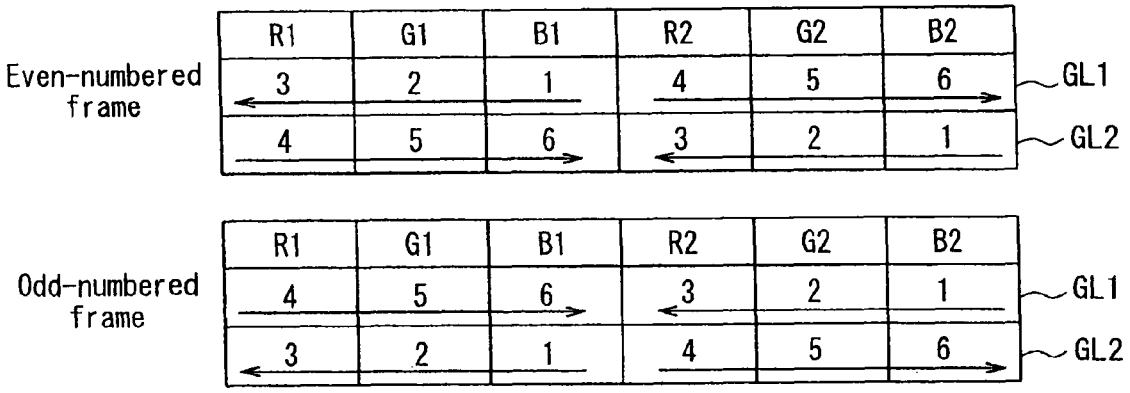
FIG. 10 is for explaining another exemplary driving order of pixels in the active matrix liquid crystal display device in accordance with Embodiment 1 of the present invention.

Alternatively, as shown in FIG. 10, it is also preferable that while the driving order of the pixels may be different from one line to another, the driving order of the pixels may be different from one frame to another. In the example of FIG. 10, during an even-numbered frame, the pixels corresponding to odd-numbered gate lines are driven in the order of B1, G1, R1, R2, G2 and B2, whereas the pixels corresponding to even-numbered gate lines are driven in the order of B2, G2, R2, R1, G1 and B1. Then, during an odd-numbered frame, the pixels corresponding to odd-numbered gate lines are driven in the order of B2, G2, R2, R1, G1 and B1, whereas the pixels corresponding to even-numbered gate lines are driven in the order of B1, G1, R1, R2, G2 and B2. According to the driving method of FIG. 10, the contrast of the pixels will be varied from one gate line to another, and the contrast of the pixels will be varied also from one frame to another. Therefore, the bright and dark pixels are arranged spatially in a staggered manner, thus further obscuring a display unevenness.

Figure 9:
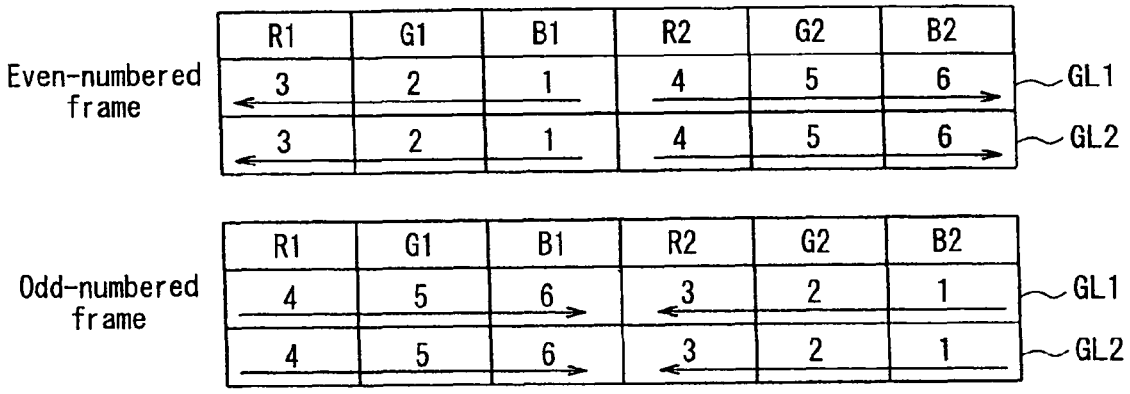
FIG. 9 is for explaining a still further exemplary driving order of pixels in the active matrix liquid crystal display device in accordance with Embodiment 1 of the present invention.

It is also preferable that the driving method shown in FIG. 9 or FIG. 10 that changes the driving order of pixels from one frame to another is combined with so-called polarity-reversed driving in which a polarity of the applied voltage to a liquid crystal capacitance 10 is reversed from one frame to another. In particular, the polarity-reversed driving may be combined with the driving method of FIG. 9, whereby a vertical striped pattern (in the direction along data lines) can be eliminated effectively.

Figure 11:
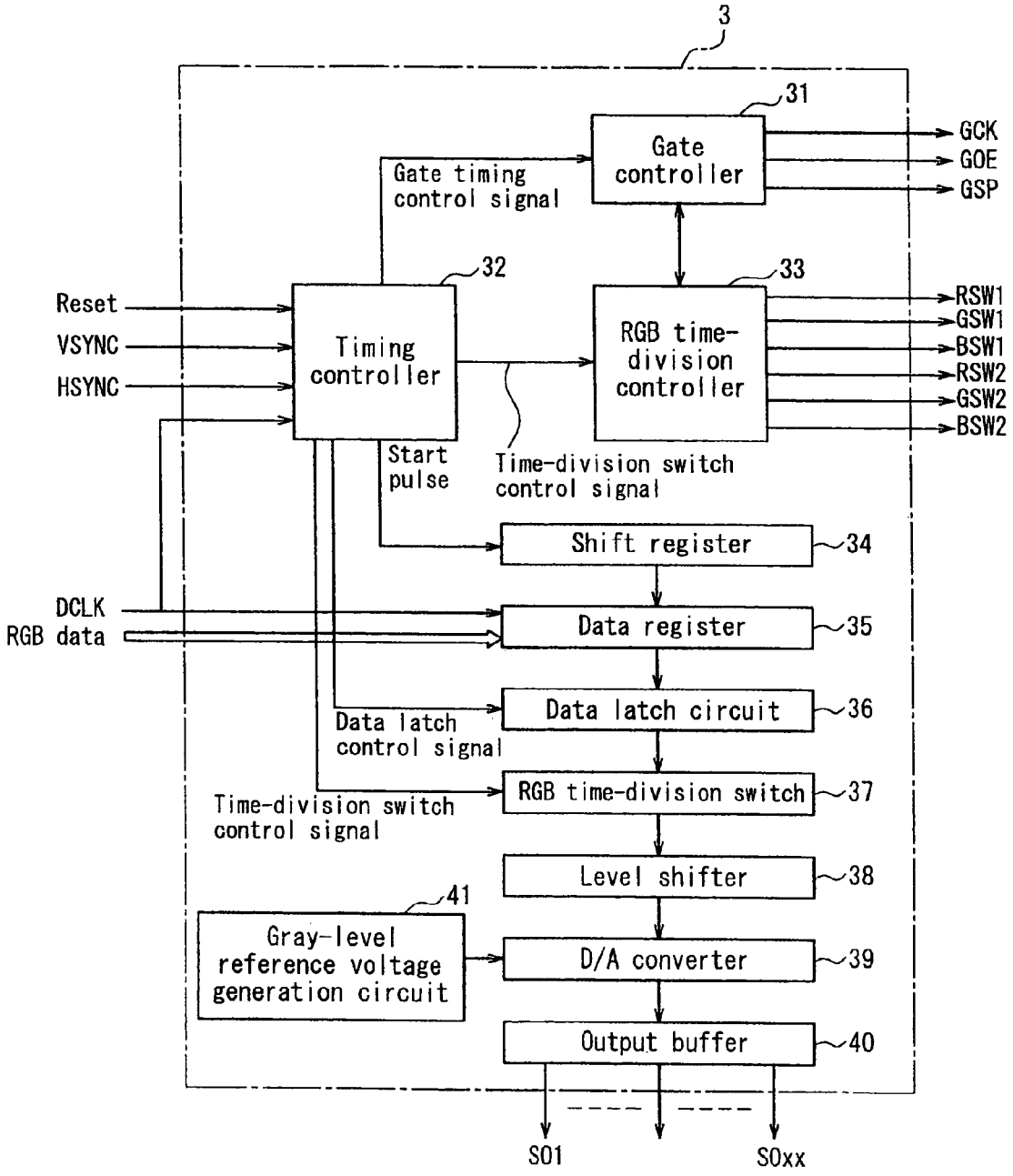
FIG. 11 is a block diagram showing the configuration of a liquid crystal driver in the active matrix liquid crystal display device in accordance with Embodiment 1 of the present invention.

Referring now to FIG. 11, the internal configuration of the liquid crystal driver 3 will be described below in detail. The liquid crystal driver 3, as shown in FIG. 11, includes a gate controller 31, a timing controller 32, a RGB time-division controller 33 (selection order changing section), a shift register 34, a data register 35, a data latch circuit 36, a RGB time-division switch 37, a level shifter 38, a D/A converter 39, an output buffer 40 and a gray-level reference voltage generation circuit 41.

The timing controller 32 receives a reset signal (Reset), a vertical synchronizing signal (VSYNC), a horizontal synchronizing signal (HSYNC) and a clock signal (DCLK) as input and generates and outputs a gate timing control signal for the gate controller 31, a start pulse for the shift register 34, a data latch control signal for the data latch circuit 36 and a time-division switch control signal for the RGB time-division controller 33 and the RGB time-division switch 37. The time-division switch control signal is a signal for instructing a driving timing of the six pixels (R1, G1, B1, R2, G2 and B2).

The gate controller 31 outputs, based on the gate timing control signal, a gate clock signal (GCK), a gate output enable signal (GOE) and a gate start pulse signal (GSP) and outputs them to the gate driver 2.

The RGB time-division controller 33 generates, based on the time-division switch control signal from the timing controller 32, pixel selection signals RSW1, GSW1, BSW1, RSW2, GSW2 and BSW2 that are in synchronization with the signals from the gate controller 31 and outputs the same.

The start pulse from the timing controller 32 is fed to the data register 35 via the shift register 34. The data register 35 receives RGB data as well as the clock signal (DCLK), and the received RGB data is latched in the data latch circuit 36 in accordance with a supplied signal from the shift register 34. The RGB data latched in the data latch circuit 36 is transmitted to the RGB time-division switch 37 in accordance with the data latch control signal.

In accordance with the time-division switch control signal, the RGB time-division switch 37 outputs the RGB data signals corresponding to the six pixels (R1, G1, B1, R2, G2 and B2), respectively, in the order according to the driving order of these pixels. The thus output RGB data signals are fed to the D/A converter 39 via the level shifter 38, which are converted to analog signals having amplitudes in accordance with the gray-level reference voltages supplied from the gray-level reference voltage generation circuit 41. Then, the converted analog signals are stored in the output buffer 40, and subsequently are output from the source signal output line SO to the respective data lines DLs under the open/close control of the switches ASWs by the pixel selection signals RSW1, GSW1, BSW1, RSW2, GSW2 and BSW2 as stated above.

The above description exemplifies the case where the drive control circuit according to the present invention operates as the liquid crystal driver 3 that is an integrated circuit having the functions of a controller as well as a source driver. However, as long as it is a circuit equivalent to that of FIG. 1, any circuit configuration is possible. Alternatively, the controller and the source driver may be implemented with different integrated circuits.

The above-described liquid crystal driver 3 and the gate driver 2 are configured so that they are connected externally to the liquid crystal panel 1. However, the present embodiment is not limited to this configuration, and it is also possible to mount a drive circuit, made of polysilicon (p—Si) or continuous-grain silicon (CGS), equivalent to the liquid crystal driver 3 and the gate driver 2 of FIG. 11 monolithically on a substrate of the liquid crystal panel 1.

The present embodiment exemplifies the configuration where six data lines DL1 to DL6 are grouped to be connected to one source signal output line SO, where six RGB pixels form one unit and the driving order of these six pixels is controlled. However, the number of the data lines connected to one source signal output line is not limited to six. For instance, when a three primary colored color filter is used, the number of the grouped data lines can be multiples of 3 including 9 and 12 or more.

(Embodiment 2)

Figure 12:
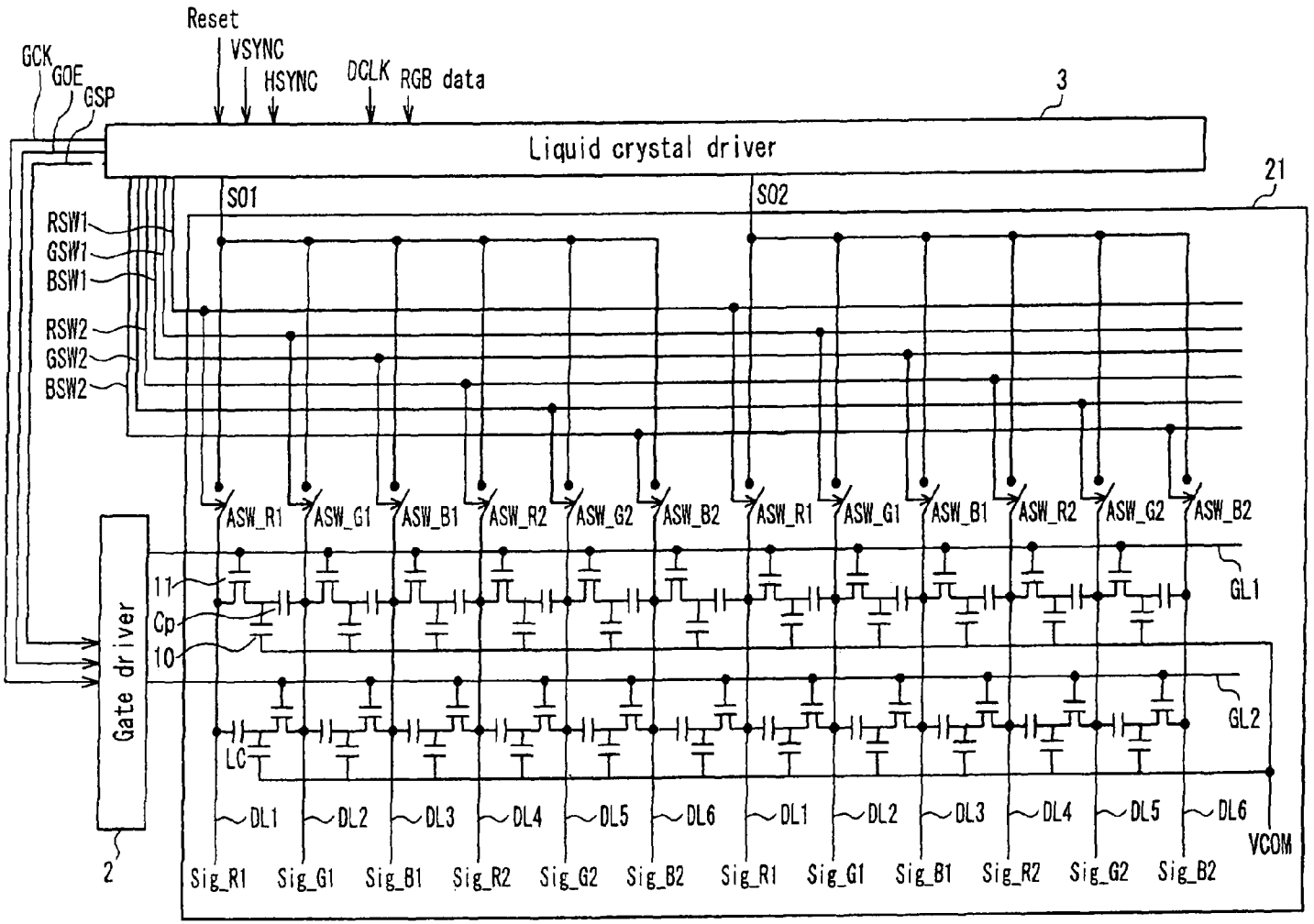
FIG. 12 is an equivalent circuit diagram illustrating the configuration of an active matrix liquid crystal display device in accordance with Embodiment 2 of the present invention.
Figure 13:
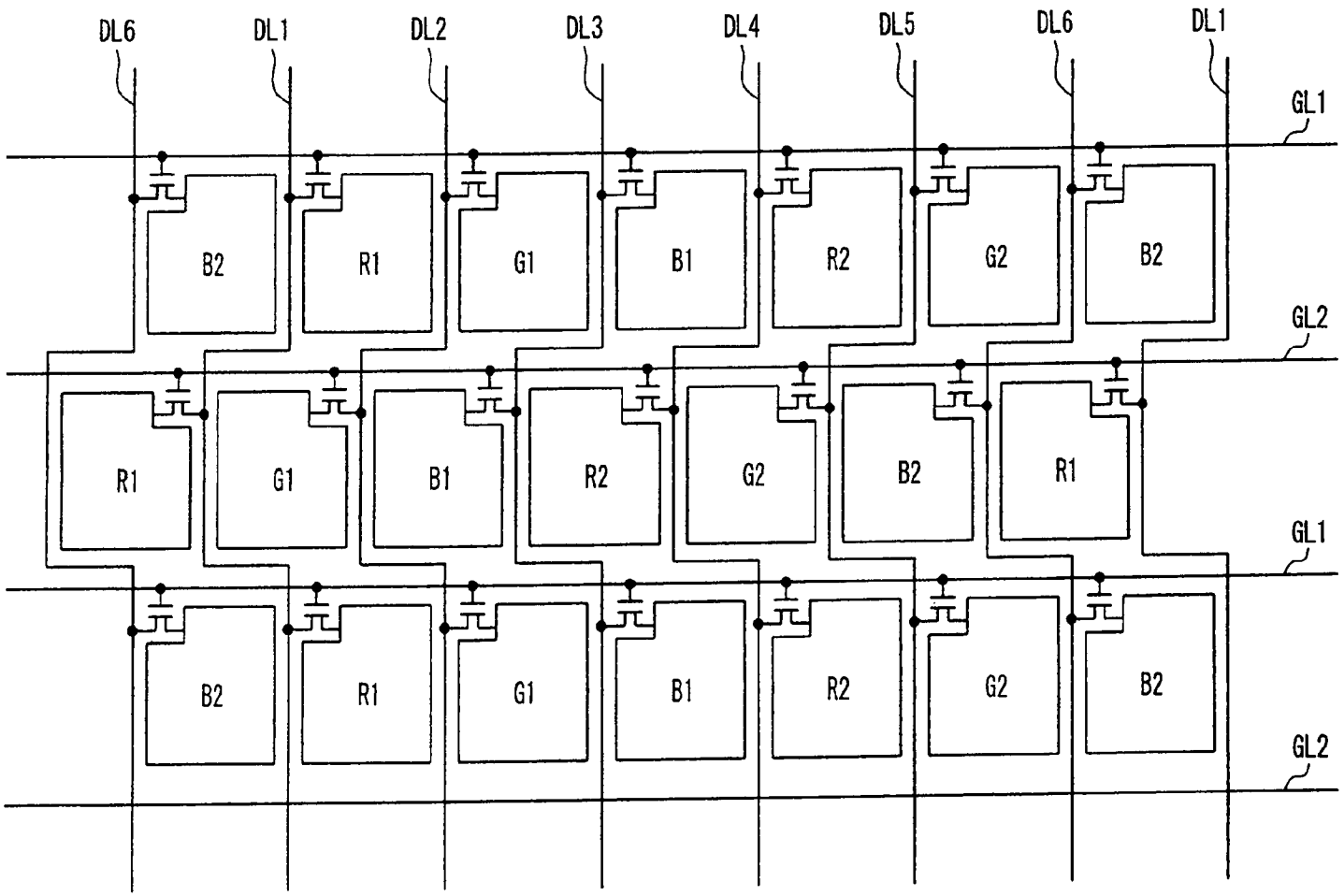
FIG. 13 is for explaining a color pixel arrangement of the active matrix liquid crystal display device in accordance with Embodiment 2 of the present invention.
Figure 14:
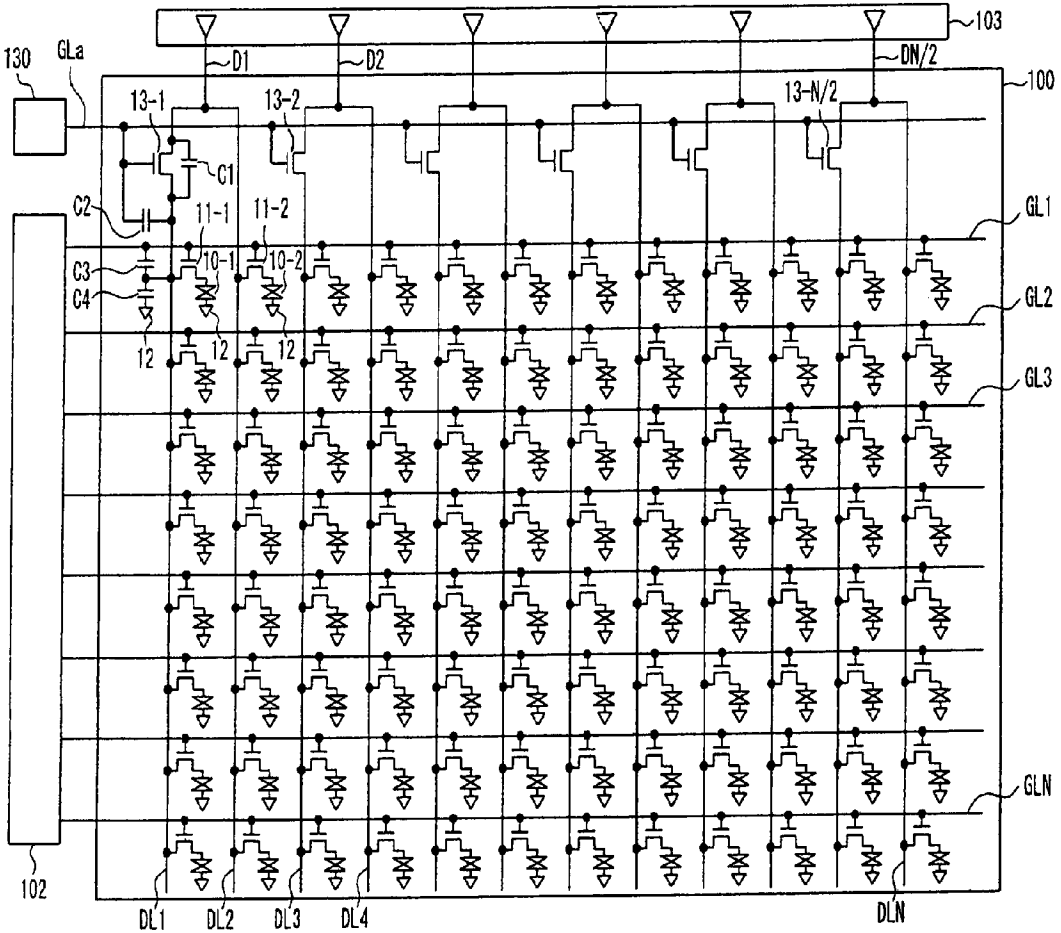
FIG. 14 (PRIOR ART)
FIG. 14 is an equivalent circuit diagram illustrating an exemplary configuration of a conventional active matrix display device.
Figure 15:
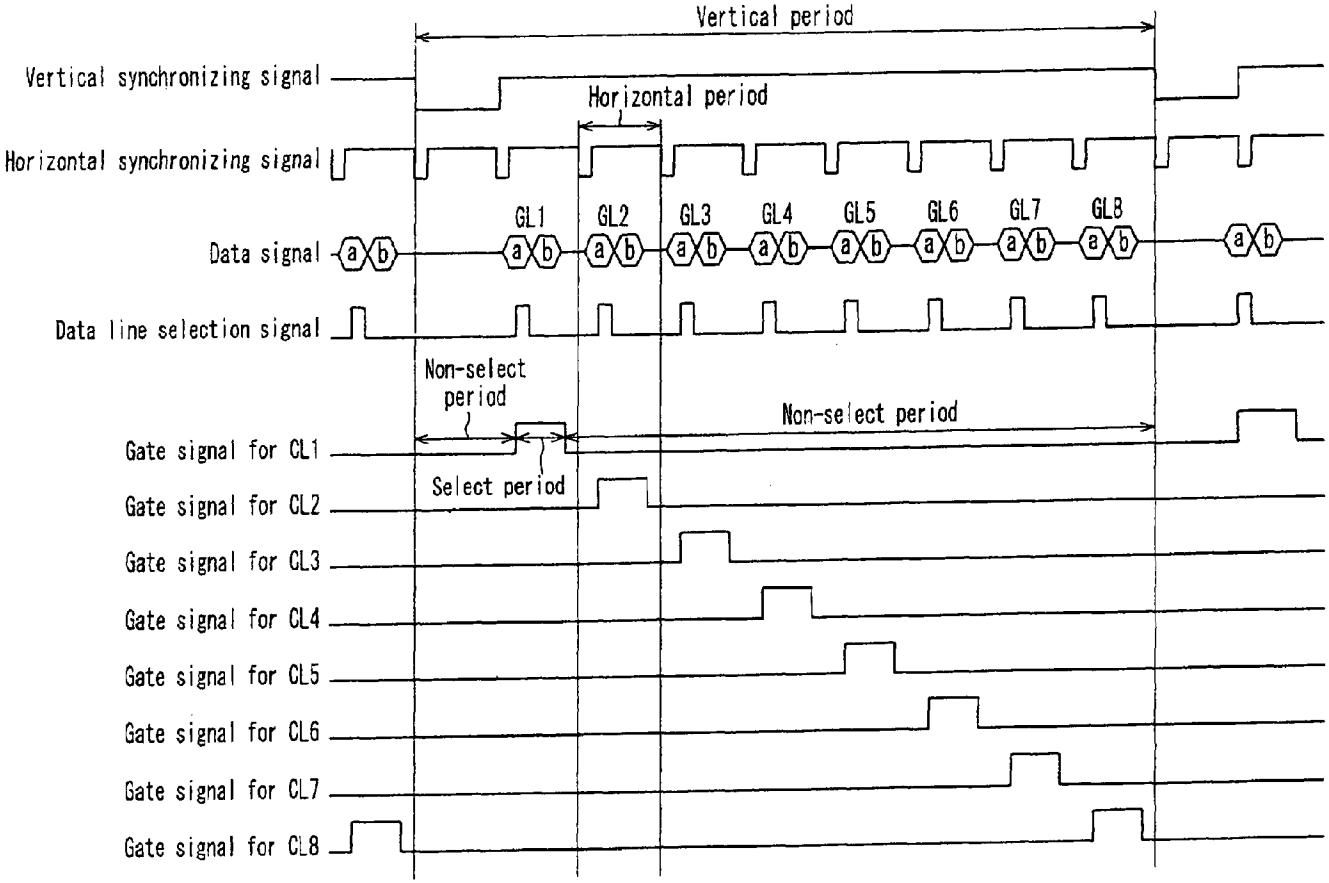
FIG. 15 (PRIOR ART)
FIG. 15 shows waveforms of major driving signals in a conventional active matrix display device.

Referring now to FIG. 12 to FIG. 13, another embodiment of the present invention will be described below. In the following description, the same reference numerals are assigned to the elements having similar functions to those described in Embodiment 1, and their detailed explanations are not repeated.

FIG. 12 is an equivalent circuit diagram illustrating the major configuration of an active matrix liquid crystal display device in accordance with the present embodiment. As shown in FIG. 12, the liquid crystal display device of the present embodiment mainly includes a liquid crystal panel 21, a gate driver 2 and a liquid crystal driver 3.

The liquid crystal panel 21 includes a three primary colored (RGB) color filter layer forming a delta arrangement as shown in FIG. 13, and the liquid crystal panel 21 is different from the liquid crystal panel 1 of Embodiment 1 in that data lines DLs, pixel TFTs, pixel electrodes and the like are arranged corresponding to the delta arrangement of the color filter layer. Incidentally, the equivalent circuit diagram of FIG. 12 illustrates a connecting relationship among the data lines DLs, the pixel TFTs, liquid crystal capacitances and the like, and does not illustrate the positional relationship of pixels on the matrix substrate.

The liquid crystal panel 21 is similar to the liquid crystal panel 1 in that six data lines DL1 to DL6 are grouped to be connected to one source signal output line SO. However, pixels R1, G1, B1, R2, G2 and B2 connected with a gate line GL2 (even-numbered line) are arranged at positions shifted from pixels R1, G1, B1, R2, G2 and B2 connected with a gate line GL1 (odd-numbered line) to the left by the distance corresponding to 1.5 pixels, so as to form a delta arrangement.

Furthermore, the data line DL1 in the liquid crystal panel 21 bends so as to run on the left side of a pixel R1 connected with the gate line GL1 (odd-numbered line) and run on the right side of a pixel R1 connected with the gate line GL2 (even-numbered line). As a result, the pixel R1 along the gate line GL1 has a pixel TFT 11 connected with a pixel electrode thereof and arranged on the right side of the data line DL1, while the pixel R1 along the gate line GL2 has a pixel TFT 11 connected with a pixel electrode thereof and arranged on the left side of the data line DL1. Similarly, the data line DL2 bends so as to run on the left side of a pixel G1 connected with the gate line GL1 and run on the right side of a pixel G1 connected with the gate line GL2. Similarly, the data lines DL3 to DL6 also bend to run through pixels B1, R2, G2 and B2.

In the thus configured liquid crystal panel 21, the liquid crystal driver 3 drives six pixels (R1, G1, B1, R2, G2 and B2) in the order as shown in FIG. 4 or FIG. 5. The configuration of the liquid crystal driver 3 in the present embodiment is similar to that of Embodiment 1, and therefore the duplicated explanations are not repeated.

In this way, the driving order of the six pixels is controlled so that a pair of pixels having the largest electric potential difference in one horizontal period are blue pixels, whereby the influence on the human's visual impression can be minimized.

Note here that although a driving method of changing a driving order of pixels from one line to another as shown in FIG. 7 or FIG. 8 is effective for Embodiment 1, such a driving method does not affect the spatial arrangement of bright and dark pixels in the present embodiment, and therefore such a driving method does not have any effect of eliminating a display unevenness.

However, the method as shown in FIG. 9 in Embodiment 1, in which a driving order of pixels is changed from one frame to another, has an effect of obscuring a display unevenness because pixels B1 and B2 will be alternately in a bright or a dark state for each frame.

The present embodiment also exemplifies the driving order of six pixels connected with six data lines DL1 to DL6 starting from a blue pixel and ending with another blue pixel. However, similarly to Embodiment 1, a substantially same effect can be obtained even when it starts with a red pixel and ends with another red pixel.

The present embodiment also is configured so that six data lines DL1 to DL6 are grouped to be connected to one source signal output line SO, where six RGB pixels form one unit and the driving order of these six pixels is controlled. However, the number of the data lines connected to one source signal output line is not limited to six. For instance, when a three primary colored color filter is used, the number of the grouped data lines can be multiples of 3 including 9 and 12 or more.

INDUSTRIAL APPLICABILITY

The present invention is applicable to an active matrix display device achieving high quality display by reducing the degradation of an image quality due to a parasitic capacitance or the like and a drive control circuit used therefor.

The invention claimed is:

1. An active matrix display device, comprising:

pixels of three colors that form a stripe arrangement or a delta arrangement, the pixels having a red-green-blue-red-green-blue (RGBRGB) pixel structure;

a plurality of scanning lines and a plurality of data lines corresponding to the arrangement of the pixels;

a plurality of switching elements corresponding to the pixels, wherein ON/OFF of the plurality of switching elements is controlled by signals flowing through the plurality of scanning lines, and when a switching element is turned ON, a signal flowing through a data line is written to a pixel corresponding to the switching element;

wherein, among the plurality of data lines, n (n denotes a multiple of 3 that is 6 or larger) adjacent data lines form one group and are connected to output signal lines of a data line drive circuit that generates a signal to be output to each data line, and each data line is provided with a selection switch that controls electrical connectivity between the data line and a corresponding output signal line of the data line drive circuit; and wherein the active matrix display device further includes, a selection order changing section to control ON/OFF of the selection switches so as to control an order in which the n data lines forming one group are connected with the corresponding output signal line of the data line drive circuit, wherein the selection order changing section controls the order so that, among the n data lines forming one group, data lines corresponding to pixels of a same first color are connected to the corresponding output signal line of the data line drive circuit first and last during one horizontal period, wherein a data line corresponding to a pixel of a second color is connected immediately following the first connection of the pixel of the same first color, wherein the pixels of the same first color are one of red and blue pixels, and the pixels of the second color are green pixels, and wherein all of the n data lines are connected with the corresponding output signal line of the data line drive circuit during one horizontal period.

2. The active matrix display device according to claim 1, wherein the three colors are three primary colors of red, green and blue, and the selection order changing section controls the order so that, among the n data lines forming one group, data lines corresponding to blue pixels are connected first and last with the corresponding output signal line of the data line drive circuit during one horizontal period.

3. The active matrix display device according to claim 1, wherein the three colors are three primary colors of red, green and blue, and the selection order changing section controls the order so that, among the n data lines forming one group, data lines corresponding to red pixels are connected first and last with the corresponding output signal line of the data line drive circuit during one horizontal period.

4. The active matrix display device according to claim 1, wherein the selection order changing section controls the order of connecting the n data lines forming one group with the corresponding output signal line of the data line drive circuit so that the order is different from one horizontal period to another.

5. The active matrix display device according to claim 1, wherein the selection order changing section controls the order of connecting the n data lines forming one group with the corresponding output signal line of the data line drive circuit so that the order is different from one vertical period to another.

6. The active matrix display device according to claim 1, wherein the selection order changing section controls the order of connecting the n data lines forming one group with the corresponding output signal line of the data line drive circuit so that the order is different from one horizontal period to another and from one vertical period to another.

7. A drive control circuit for an active matrix display device including a plurality of scanning lines and a plurality of data lines corresponding to an arrangement of pixels, the arrangement of pixels having a red-green-blue-red-green-blue (RGBRGB) pixel structure, the active matrix display device further including a plurality of switching elements corresponding to the pixels, the plurality of switching elements being selectively turned ON/OFF in response to signals flowing through the plurality of scanning lines, wherein a signal flowing through a data line is written in a pixel corresponding to the switching element when a switching element is turned ON, and wherein among the plurality of data lines, n (n denotes a multiple of 3 that is 6 or larger) adjacent data lines form one group and are connected to output signal lines of a data line drive circuit that generates a signal to be output to each data line, and each data line is provided with a selection switch that controls electrical connectivity between the data line and a corresponding output signal line of the data line drive circuit, the drive control circuit comprising:

a selection order changing section to control ON/OFF of the selection switches so as to control an order of connecting the n data lines forming one group with the corresponding output signal line of the data line drive circuit;

wherein the selection order changing section controls the order so that, among the n data lines forming one group, data lines corresponding to pixels of a same first color are connected to the corresponding output signal line of the data line drive circuit first and last during one horizontal period;

wherein a data line corresponding to a pixel of a second color is connected immediately following the first connection of the pixel of the same first color, wherein the pixels of the same first color are one of red and blue pixels, and the pixels of the second color are green pixels, and wherein all of the n data lines are connected with the corresponding output signal line of the data line drive circuit during one horizontal period.

8. The drive control circuit according to claim 7, wherein the three colors are three primary colors of red, green and blue, and the selection order changing section controls the order so that, among the n data lines forming one group, data lines corresponding to blue pixels are connected first and last with the corresponding output signal line of the data line drive circuit during one horizontal period.

9. The drive control circuit according to claim 7, wherein the three colors are three primary colors of red, green and blue, and the selection order changing section controls the order so that, among the n data lines forming one group, data lines corresponding to red pixels are connected first and last with the corresponding output signal line of the data line drive circuit during one horizontal period.

10. The drive control circuit according to claim 7, wherein the selection order changing section controls the order of connecting the n data lines forming one group with the corresponding output signal line of the data line drive circuit so that the order is different from one horizontal period to another.

11. The drive control circuit according to claim 7, wherein the selection order changing section controls the order of connecting the n data lines forming one group with the corresponding output signal line of the data line drive circuit so that the order is different from one vertical period to another.

12. The drive control circuit according to claim 7, wherein the selection order changing section controls the order of connecting the n data lines forming one group with the corresponding output signal line of the data line drive circuit so that the order is different from one horizontal period to another and from one vertical period to another.

13. An active matrix display device, comprising:

pixels of three colors that form a stripe arrangement or a delta arrangement, the pixels having a red-green-blue-red-green-blue (RGBRGB) pixel structure;

a plurality of scanning lines and a plurality of data lines corresponding to the arrangement of the pixels;

a plurality of switching elements corresponding to the pixels, wherein ON/OFF of the plurality of switching elements is controlled by signals flowing through the plurality of scanning lines, and when a switching element is turned ON, a signal flowing through a data line is written to a pixel corresponding to the switching element;

wherein, among the plurality of data lines, n (n denotes a multiple of 3 that is 6or larger) adjacent data lines form one group and are connected to output signal lines of a data line drive circuit that generates a signal to be output to each data line, and each data line is provided with a selection switch that controls electrical connectivity between the data line and a corresponding output signal line of the data line drive circuit; and wherein the active matrix display device further includes, a selection order changing section to control ON/OFF of the selection switches so as to control an order in which the n data lines forming one group are connected with the corresponding output signal line of the data line drive circuit, wherein the selection order changing section controls the order so that, among the n data lines forming one group, data lines corresponding to pixels of a same first color are connected to the corresponding output signal line of the data line drive circuit first and last during one horizontal period, wherein a data line corresponding to a pixel of a second color is connected immediately following the first connection of the pixel of the same first color, wherein the pixels of the same first color are one of red and blue pixels, and the pixels of the second color are green pixels, and wherein at least 6 data lines are connected with the corresponding output signal line of the data line drive circuit during one horizontal period.

14. The active matrix display device according to claim 13, wherein the three colors are three primary colors of red, green and blue, and the selection order changing section controls the order so that, among the n data lines forming one group, data lines corresponding to blue pixels are connected first and last with the corresponding output signal line of the data line drive circuit during one horizontal period.

15. The active matrix display device according to claim 13, wherein the three colors are three primary colors of red, green and blue, and the selection order changing section controls the order so that, among the n data lines forming one group, data lines corresponding to red pixels are connected first and last with the corresponding output signal line of the data line drive circuit during one horizontal period.

16. The active matrix display device according to claim 13, wherein the selection order changing section controls the order of connecting the n data lines forming one group with the corresponding output signal line of the data line drive circuit so that the order is different from one horizontal period to another.

17. The active matrix display device according to claim 13, wherein the selection order changing section controls the order of connecting the n data lines forming one group with the corresponding output signal line of the data line drive circuit so that the order is different from one vertical period to another.

18. The active matrix display device according to claim 13, wherein the selection order changing section controls the order of connecting the n data lines forming one group with the corresponding output signal line of the data line drive circuit so that the order is different from one horizontal period to another and from one vertical period to another.

* * * * *